United States Patent [19]

Sarcia

[11] Patent Number: 4,841,732

[45] Date of Patent: Jun. 27, 1989

[54] SYSTEM AND APPARATUS FOR PRODUCING AND STORING LIQUID GASES

[76] Inventor: Domenico S. Sarcia, 114 Sunset Rd., Carlisle, Mass. 01741

[21] Appl. No.: 138,706

[22] Filed: Dec. 28, 1987

[51] Int. Cl.[4] ..... F25J 3/00

[52] U.S. Cl. ..... 62/36; 55/158; 62/49.1; 62/51.1

[58] Field of Search ..... 62/11, 36, 49, 514 R; 55/16, 23, 158

[56] References Cited

U.S. PATENT DOCUMENTS

| | | | |
|---|---|---|---|
| 2,909,903 | 10/1959 | Zimmermann | 62/8 |
| 4,279,127 | 7/1981 | Longsworth | 62/514 R |
| 4,510,760 | 4/1985 | Wieland | 62/49 |
| 4,529,411 | 7/1985 | Goddin, Jr. et al. | 55/16 |
| 4,542,010 | 9/1985 | Roman et al. | 55/158 |
| 4,575,386 | 3/1986 | Hamers | 62/11 |
| 4,591,365 | 5/1986 | Burr | 55/16 |
| 4,701,187 | 10/1987 | Choe et al. | 55/16 |

*Primary Examiner*—Ronald C. Capossela
*Attorney, Agent, or Firm*—Irwin P. Garfinkle

[57] ABSTRACT

The disclosed system produces liquid nitrogen from ambient air which is supplied under pressure to a membrane separator. Most of the gases other than nitrogen permeate the membranes, and are vented to the atmosphere leaving almost pure nitrogen gas. The nitrogen gas is then supplied to a Dewar container in the neck of which is mounted the cylindrical cold head of a miniature cryogenic refrigerator. The temperature of the cold head is maintained below the liquefaction temperature of the nitrogen so that the gas is liquified as it passes over the cold head in heat exchanging relationship.

10 Claims, 1 Drawing Sheet

SYSTEM AND APPARATUS FOR PRODUCING AND STORING LIQUID GASES

BACKGROUND OF THE INVENTION

Various systems and processes for the production of liquid nitrogen have been known for many years, but the known systems have been more useful for the generation of large quantities of nitrogen used in large scale systems. For example, the Zimmerman U.S. Pat. No. 2,909,903 issued in 1959, shows a system designed to produce liquified gases at a rate of 110 liters per hour. A small research laboratory would generally require no more than 12 liters per hour. Unlike the Zimmerman system which uses two expansion engines and precooling, I have devised a miniaturized, portable, integrated system which can produce and store up to 12 liters of liquid nitrogen per hour using a small cryogenic refrigerator having a free piston displacer mounted in the neck of a Dewar container, and I generate nitrogen gas from ambient air pumped through a membrane separator. The entire system is capable of packaging in a compact portable unit.

SUMMARY OF THE INVENTION

In accordance with this invention, filtered ambient air is supplied under pressure to a passive gas separator where nitrogen gas is separated from the other gases in air. As disclosed, the air is supplied to the input of a hollow elongated gas permeable membrane where the "fast" gases are dissolved and permeate the membranes while the "slow" gases traverse it. The major constituents of air are oxygen, nitrogen and argon. Because oxygen and argon have faster permeability rates than nitrogen, the non-permeate output of the separator can be adjusted to contain approximately 99% nitrogen, which is supplied to the liquefier system, while the permeate mixture of oxygen, nitrogen and argon is vented to the atmosphere. The liquefier system comprises a cryogenic refrigerator having a cylindrical body, the upper portion of which houses the hot zone and the lower portion of which houses the cold head. The cryogenic refrigerator is inserted into the neck of the Dewar container, with its cold head supported entirely outside of the Dewar. This arrangement is beneficial since the warm portion of the refrigerator is outside of the cooled Dewar and thereby adds no heat to it. When the refrigerator is not operating, the Dewar begins to heat up. By positioning the cold head in the narrow neck, heat losses are minimized because the free circulations of gases is inhibited, and the heat path into the container is materially increased, thereby maintaining a low temperature for a longer period of time when the cold head is not operating.

The nitrogen gas passing over the cold head is liquefied, and the liquified nitrogen drops into the Dewar container where it is stored and maintained below its boiling point by the operation of the refrigerator.

THE DRAWING

The single drawing is a diagrammatic representation of the invention.

DETAILED DESCRIPTION OF THE INVENTION

Figure 1:
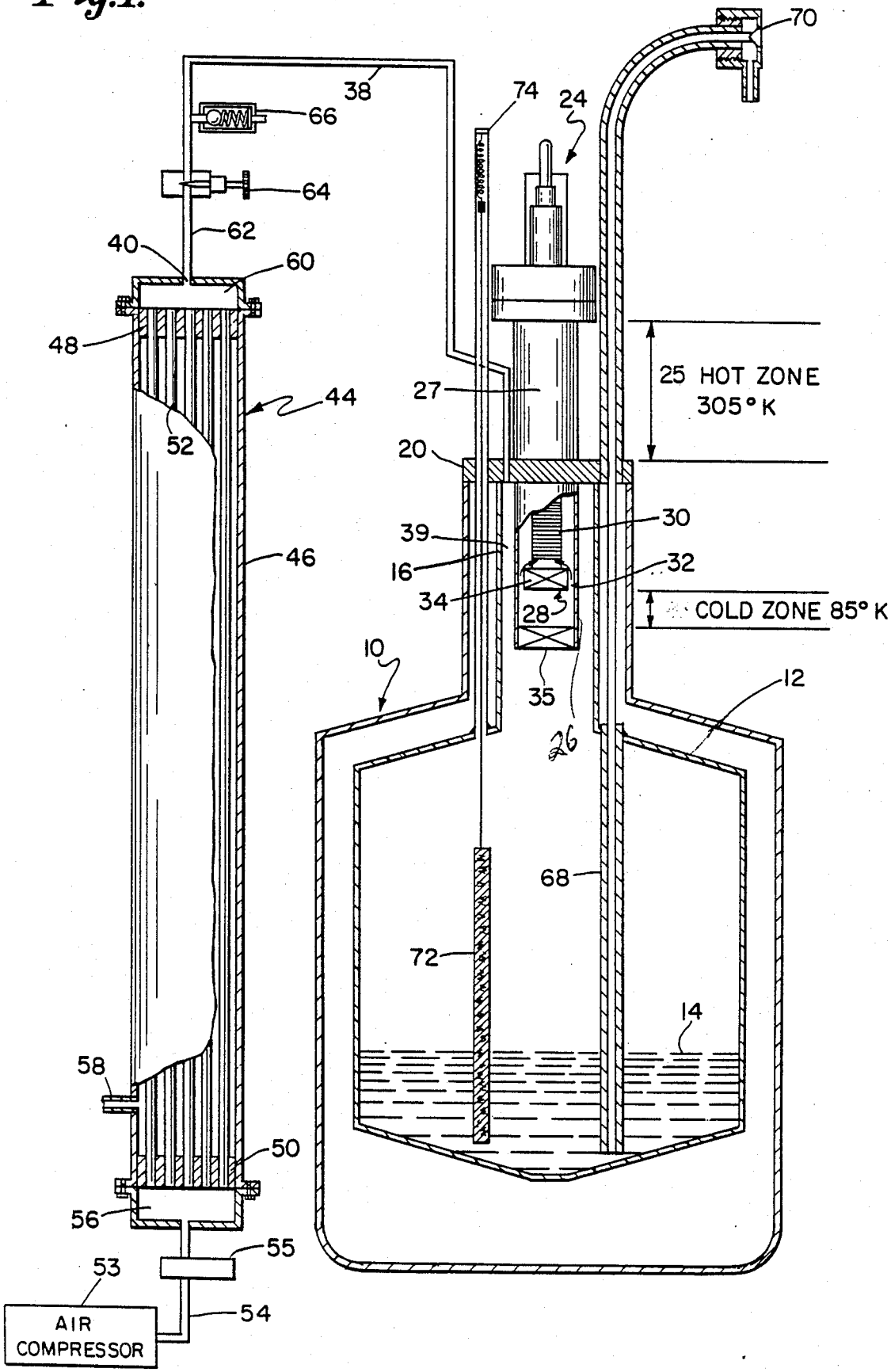

As seen in the drawing, the system for producing and storing liquid nitrogen includes a double wall Dewar container 10 which has a near vacuum between its double walls. The container is made in two sections, the lower section providing a reservoir 12 for storing cold liquids 14 and the upper section providing an elongated cylindrical neck 16 of reduced diameter. The upper end of the neck 16 is closed by means of an insulated cap 20.

A cylindrical cryogenic refrigerator 24 is supported in the cap 20 so that its cylindrical cold head 26 is positioned entirely within the cylindrical neck 16, and with its hot zone 25 is located outside the neck.

The cryogenic refrigerator 24 is essentially the same as that disclosed and claimed in my co-pending U.S. patent application Ser. No. 107/021,258, filed Mar. 13, 1987, and entitled "Method And Apparatus For Snubbing The Movement Of A Free, Gas-Driven Displacer In A Cooling Engine.".

Briefly, the cryogenic referigerator 24 comprises an expander cylinder 27 within which is located a free, gas driven displacer 28. A conventional screen regenerator 30 located within the displacer 28 provides bi-directional flow through it. A standard annular gap 32 located at the lower end of the displacer permits the passage of compressed helium, or other refrigerant gas, from the end of the cylinder in to the regenerator 30. As disclosed in my prior application, an arrangement of permanent magnets (or electromagnets) is provided for snubbing the travel of the free piston before striking the ends of the cylinder. Only one set of the magnets is shown, i.e. the magnet 34 fixed to the bottom of the displacer 28, and the magnet 35 fixed to the bottom of the cylinder. Another set, not illustrated, is mounted on the top end of the displacer and at the top of the cylinder. The displacer is driven by the differential pressures applied to it from a helium compressor and controlled by means of a spool valve, not shown in this drawing, but described in my aforesaid prior application. Although the details of the control system are not relevant to the present invention, for an understanding thereof, reference again may be made to the aforesaid co-pending patent application. Suffice to say, that the cryogenic refrigerator 24 is capable of produces temperatures below the boiling point of nitrogen, oxygen and argon.

The nitrogen gas to be liquified is admitted to the Dewar container through an inlet tube 38 which is connected to the narrow passageway 39 between the outer cylindrical wall of the cold head 26 the cryogenic refrigerator 24 and the inner wall of the cylindrical neck of the Dewar container. While the disclosed embodiment simply uses the annular space between the neck and the refrigerator, the invention contemplates the use of other passageways for the gases, for example, a tube coiled around the refrigerator in intimate heat exchanging relationship with the cold head 26.

To produce nitrogen gas for liquefaction, I make use of a gas permeable membrane separator 44 manufactured by Permea Inc. under the trademarks Prism and Alpha. The membranes separate the gases on the basis of selective permeation. Each gas has a characteristic permeation rate that is a function of its ability to dissolve and diffuse through a membrane. This characteristic rate allows "fast" gases such as nitrogen. While the membrane separator is very useful in this particular application, other types of passive separators, for example, the molecular sieve, will be advantageous for other applications.

The membrane separator 44 comprises an elongated hollow gas impermeable cylinder 46, closed at both ends by closure members 48 and 50 through which thousands of tiny hollow semi-permeable membranes 52 extend and are supported. Pressurized ambient air is supplied from an air compressor 53 to the hollow membranes 52 via a gas line or conduit 54, a solenoid controlled valve 55 and a plenum 56. A gas line 58 provides an outlet for the gases which permeate the membranes 52. Gases which do not permeate the membranes 52 (the nonpermeates) are collected in an outlet plenum 60 and are delivered to a gas line 62.

The permeate and non-permeate gases are mixtures, the constituents of which depend on a number of controllable factors, namely, the length of the membranes, the pressure of the gas mixture supplied from the source 53, and the pressure drop developed within the separator. Air is composed of a mixture of gases consisting primarily of 78% Nitrogen, 21% Oxygen, 0.9% argon and other trace gases in very small quantities, which in the disclosed system are ignored.

In the system as reduced to practice, the membrane separator was supplied with filtered air from the air compressor 53 at 100 pounds per square inch. The membranes allow oxygen, water vapor and carbon dioxide to permeate faster than nitrogen, therefore, if the flow rate is slow enough, and the membrane fibers length long enough, the only remaining gas species are nitrogen and a trace of argon. The gases which permeate through the membrane walls are then vented to the atmosphere. The pressure drop through the membrane fibers was about 5 pounds per square inch, so that the pressure at the output of the separator at gas line 52 was at 95 pounds per square inch.

The 99% pure nitrogen produced at the output from the membrane separator 44 is applied to the passageway 40 through the line 62, a needle valve 64, a pressure relief valve 66 and the line 38. The cold head 26 of the cryogenic refrigerator is maintained at or below aprpoximately 85 degrees Kelvin, the liquefaction temperature of nitrogen at approximately 10 pounds per square inch, so that the nitrogen gases passing over it are liquified and drop into the reservoir 12.

The liquid outlet from the reservoir 14 comprises a tube 68 extending from near the bottom of the reservoir through the cap 20. Flow out of the reservoir 12 is measured by means of a level measuring device consisting of a float 72 connected to a magnetic sensor 74.

IN OPERATION

First, the air compressor is turned on, and compressed filtered air is applied to the gas separator 44. The nitrogen gas which exits the gas separator 44 enters the passageway 39 between the inside wall of the dewar neck 16 and the cold head 26 of the refrigerator 24. Until the temperature of the system is sufficiently reduced to maintain the nitrogen in liquid form, the nitrogen gas continues to flow down through the annular passageway 39 and into the reservoir 14. When the pressure in the reservoir reaches 10 pounds per square inch, the pressure relief valve opens and the nitrogen in the reservoir vents to the atmosphere. At this point the refrigerator 24 is turned on by activating the helium compressor (not shown).

As more fully described in my earlier application, the high pressure gas in the lower volume of the cylinder 27 expands up through the annular gap 32 and into the regenerator matrix, cooling the copper wires of the matrix as the gas expands to create a cold zone. When the temperature of the cold zone reaches about 85 degrees Kelvin, liquid nitrogen begins to form in droplets on the outside surface of the cylinder at the cold zone. As the droplets fall into the warm reservoir 14, they adsorb the heat from the dewar walls and are again vaporized. This gas is again liquified by the cold head and the cycle continues until the temperature of the reservoir reaches 85 degrees K, at which time liquid nitrogen begins to accumulate in the reservoir. As this occurs, the pressure in the reservoir reduces and fresh nitrogen gas begins to flow at a steady rate and is liquified.

When the reservoir is full, a signal from the level sensor is used to turn off the refrigerator compressor, the air compressor 53 and the air inlet valve 55 to the separator 44.

The small thermal leak from the outer to the inner Dewar container walls results in a static boil off rate of about 0.1 to 0.2 liter per day. This boil off pressurizes the reservoir to the set pressure of 10 pounds per square inch of the pressure relief valve. When liquid withdrawal is required, the valve 70 is opened, and the pressurized gas forces the liquid nitrogen up the discharge tube and out to another collection Dewar.

While a single embodiment has been disclosed, it will be clear to person skilled in the art that the invention is subject to various modifications within the scope of this invention. For example, if it is desired to liquify oxygen rather than nitrogen, oxygen gas may be derived by pumping compressed air through a molecular sieve, and then applying the oxygen to the passageway 40 while maintaining the cold head 26 at or below the liquefaction temperature of oxygen.

As used herein, the term passive gas separator is intended to mean a separator or filter which separates the various gases in a mixture by mechanical means, and without the use of heat or chemical reactions. In the illustrated embodiment, ambient air is simply pumped through the separator.

In summary, I believe I have invented an integrated and miniaturized system for producing and liquifying selected components of air using a passive filter for deriving the selected gas from compressed ambient air, and then liquefying the gas in a unique sub-combination comprising a cylindrical cold head 26 mounted within the cylindrical neck of a Dewar container in which the liquefied gases are stored. It is intended that the inventions be limited only by the following claims as interpretted in the light of the prior art.

I claim:

1. A system for converting a gas to a liquid comprising:
   - a closed insulated container having a reservoir and a neck;
   - a cryogenic refrigerator having a cold head supported within said neck;
   - a narrow passageway between said cold head and said neck:
   - a source of said gas;
   - means for supplying the gas from said source to said narrow passageway under pressure, whereby said gas flows through said passageway in heat exchanging relationship with said cold head, the temperature of said cold head being below the liquefaction temperature of said gas, whereby said gas liquefies and drops into said reservoir.

2. The invention as defined in claim 1 wherein said gas is an element of ambient air.

3. The invention as defined in claim 2 wherein said source of gas consists of: a supply of compressed ambient air, and a passive gas separator for separating said gas from compressed ambient air, said gas being supplied to said passageway.

4. The invention as defined in claim 3 wherein said gas is nitrogen.

5. The invention as defined in claim 2 wherein said gas is nitrogen, and wherein said source of gas comprises:

a hollow gas impermeable cylinder closed at both ends; plurality of hollow gas permeable fiber membranes supported within and extending through the ends of said cylinder; means for supplying pressurized air to the interior of said hollow membranes at one end of said cylinder, most of the oxygen and argon in the air permeating said membranes intermediate the ends of said cylinder, whereby almost pure nitrogen passes through the ends of said membranes for supply to said passageway.

6. The inventions as defined in claim 1 wherein said neck and said cold head are cylindrical, the space between said neck and said cold head providing an annular passageway, said cold head being maintained at or below the liquefaction temperature of said gas.

7. The invention as defined in claim 6 wherein said gas is an element of ambient air.

8. The invention as defined in claim 7 wherein said source consists of means for compressing ambient air, a passive gas separator for separating the gaseous elements of the ambient air, and means for collecting said gas for application to said cold head.

9. The invention as defined in claim 8 wherein said gas is nitrogen.

10. The invention as defined in claim 7 wherein said source of gas comprises:

a hollow gas impermeable cylinder closed at both ends; a plurality of hollow gas permeable filter membranes supported within and extending through the ends of said cylinder; means for supplying pressurized air to the interior of said hollow membranes at one end of said cylinder, most of the oxygen and argon in the air permeating said membranes intermediate the ends of said cylinder, whereby almost pure nitrogen passes through the ends of said membranes.

* * * * *